US011497312B2

(12) United States Patent
Hu

(10) Patent No.: US 11,497,312 B2
(45) Date of Patent: Nov. 15, 2022

(54) SIDE FRAME AND A STORAGE RACK COMPRISING THEREOF

(71) Applicant: Designa Inc., Guangdong (CN)

(72) Inventor: Yajun Hu, Guangdong (CN)

(73) Assignee: DESIGNA INC., Guangdong (CN)

( * ) Notice: Subject to any disclaimer, the term of this patent is extended or adjusted under 35 U.S.C. 154(b) by 116 days.

(21) Appl. No.: 16/978,845

(22) PCT Filed: May 11, 2020

(86) PCT No.: PCT/CN2020/089618

§ 371 (c)(1),
(2) Date: Sep. 8, 2020

(87) PCT Pub. No.: WO2020/228678

PCT Pub. Date: Nov. 19, 2020

(65) Prior Publication Data

US 2021/0219722 A1 Jul. 22, 2021

(30) Foreign Application Priority Data

May 10, 2019 (CN) ..... 201910389656.X

(51) Int. Cl.
*A47B 96/06* (2006.01)
*A47B 96/02* (2006.01)
(Continued)

(52) U.S. Cl.
CPC ..... *A47B 96/06* (2013.01); *A47B 96/024* (2013.01); *A47B 47/0075* (2013.01); *A47B 96/1441* (2013.01); *A47B 2220/0061* (2013.01)

(58) Field of Classification Search
CPC ... A47B 96/06; A47B 96/024; A47B 47/0075; A47B 96/1441; A47B 2220/0061
See application file for complete search history.

(56) References Cited

U.S. PATENT DOCUMENTS 5,191,986 A * 3/1993 Huizenga ..... A47B 61/00 211/189
9,167,896 B1 10/2015 Wu
(Continued)

FOREIGN PATENT DOCUMENTS

CN 201375278 Y 1/2010
CN 203262800 U 11/2013
(Continued)

*Primary Examiner* — Devin K Barnett
(74) *Attorney, Agent, or Firm* — Muncy, Geissler, Olds & Lowe, P.C.

(57) ABSTRACT

The invention provides a side frame, which comprises a frame body formed by connecting vertical columns and a horizontal bar; and a plurality of supporting arms provided on the frame body; the vertical columns are provided with a plurality of mounting holes, two ends of each of the supporting arms are respectively connected with mounting holes of two of the vertical columns of the frame body; one end of the horizontal bar of the frame body is provided with a fixing device for installing the frame body to a wall body. The present invention also provides a storage rack with side frames. The storage rack comprises at least two side frames and a plurality of boards, each of which is positioned between two side frames, and can be detachably connected to the supporting arms on the side frames. The side frames of the present invention have simple structure and strong practicability. The supporting arms of the side frames can form a stable connection with the frame body of the side frames, thereby improving the structural strength of the side frames. The invention of the storage rack with the side racks has better supporting capacity and load bearing effect, thereby improving the practicability and stability of the storage rack.

12 Claims, 4 Drawing Sheets

(51) Int. Cl.

| | |
|---|---|
| *A47B 47/00* | (2006.01) |
| *A47B 96/14* | (2006.01) |

(56) References Cited

U.S. PATENT DOCUMENTS

| | | | | |
|---|---|---|---|---|
| 9,888,770 | B1 * | 2/2018 | Chen | A47B 57/34 |
| 2016/0235195 | A1 * | 8/2016 | Ahart | A47B 96/024 |

FOREIGN PATENT DOCUMENTS

| | | | |
|---|---|---|---|
| CN | 108477854 | A | 9/2018 |
| CN | 110074556 | A | 8/2019 |
| CN | 210471440 | U | 5/2020 |
| CN | 210471537 | U | 5/2020 |
| JP | 2001-112590 | A | 4/2001 |

* cited by examiner

SIDE FRAME AND A STORAGE RACK COMPRISING THEREOF

TECHNICAL FIELD

The invention relates to a side frame and a storage rack comprising thereof.

TECHNICAL BACKGROUND

Storage racks are often used in life. Storage racks is, in common term, a multi-layered shelf, which is used to place different items according to the number of layers and height. Because this type of storage rack is simple, and at the same time convenient for production and use, it is widely used in daily life or in factories.

Most general storage racks are formed by supporting frame structures and supporting plates. Common storage rack structures on the market are relatively simple, most of which adopt the way that the supporting arms are installed on the vertical columns or the back plate through snap structure, and boards are supported on the supporting arms. Storage racks in this way are usually provided with a plurality of equidistant mounting holes vertically on the vertical columns or the back plate, and the supporting arms are provided with corresponding insertion parts matching the mounting holes. Based on the size and needs of the actual storage items, the installation position of the supporting arms on the vertical columns and back plate can be adjusted, so as to adjust the distance between two adjacent boards.

However, there is only one point of connection between the supporting arms and the vertical columns or back panel, and its support effect is not good. When holding heavy goods, the supporting arms and the boards shake easily or even break. This will greatly affect the structural strength and service life of the storage racks, and also affect the consumers' experience.

In addition, existing storage racks are only placed on the ground for storage and presentation of goods, and are not fixed on a wall. Such a design will have the problem that the rack is easy to lean forward due to external forces when the amount of goods is large, and there exists great safety concern.

SUMMARY OF THE INVENTION

The purpose of the present invention is to overcome the shortcomings and deficiencies in the prior art, and to provide a side frame with a simple structure and strong practicability. The supporting arms of the side frame can be firmly connected to the side frame body, thereby improving the structural strength of the side frame. The invention also provides a storage rack comprising the side frame. The storage rack has better supporting capacity and load-bearing effect, thereby improving the practicality and stability of the storage rack.

In order to achieve the above objectives, the present invention presents the following technical solutions: a side frame, comprising: a frame body formed by connecting vertical columns and a horizontal bar; and a plurality of supporting arms provided on the frame body; the vertical columns are provided with a plurality of mounting holes, two ends of each of the supporting arms are respectively connected with mounting holes of two of the vertical columns of the frame body; one end of the horizontal bar of the frame body is provided with a fixing device for installing the frame body to a wall body.

In the above solutions, the two ends of each of the supporting arms of the present invention are respectively connected to the two vertical columns of the frame body. This double connection mode can achieve a stable connection between the arms and the structure of the frame body. For the supporting arms of a single-sided frame body, this structure makes the supporting portion of the support arm have two points for receiving force, thereby improving the support effect of the supporting arm. When holding heavy goods, the supporting arms and the boards on the supporting arms will not shake or even break, thus greatly improves the structural strength and service life of the side frames of the storage shelf. In addition, a fixing device provided at one end of the elongated horizontal bar can fix the side frames on a wall body, so as to improve the use safety of the storage rack formed by the side frames.

In particular, each of the supporting arms comprises a body; a supporting portion for installing a board; and a first tab and a second tab for engaging the mounting holes of the vertical columns of the frame body; the body is provided with a vacant portion for the second tab to be engaged with a vertical column of the frame body; the supporting portion is connected to the body; the first tab is provided at one end of the body, the second tab is disposed near the other end of the body and facing the vacant portion, so that the supporting portion for installing the board is fixed on the frame body through the first tab and the second tab. The supporting arms of the present invention can be engaged and connected with the vertical columns of the frame body through the first tab, and at the same time, it is snapped into a vertical column of the frame body through vacant portion, so that the second tab can be engaged with the vertical column of the frame body. Therefore, the present invention realizes the stable connection between the supporting arms and the vertical columns of the frame body through double engagements of the snap connections of the first tab and the second tab, and the frame body.

The vacant portion of the body for the second tab to be engaged with a vertical column of the frame body is provided as follow: an end of the body away from the first tab is provided with a concave portion, and the concave portion is used as the vacant portion where the body and a vertical column of the frame body are engaged;

the second tab disposed near the other end of the body and facing the vacant portion is provided as follow: the second tab is provided on a side wall of the vacant portion and facing the vacant portion; a distance from the second tab to the other side wall of the vacant portion is greater than a width of an engagement location of the vertical column of the frame body. This design enables the body to be snapped into a vertical column of the frame body through the vacant portion, and has enough space for the second tab to be engaged with the vertical column of the frame body.

The supporting portion is vertically connected to the body and integrally formed with the body; the supporting portion is provided with at least one protruding part for installing a board. This design can improve the structural strength of the supporting arm.

The invention further comprising a fixing block for restricting a movement of the body of a supporting arm on the frame body; the fixing block is detachably connected to a side wall of the vacant portion, and when used, it is located between the side wall of the vacant portion and a vertical column of the frame body. After a supporting arm is engaged with a vertical column of the frame body through the first tab and the second tab, by inserting a fixing block between a side wall of the vacant portion and the vertical column of the frame body, the body of the supporting arm can be restricted from moving on the vertical column of the frame body to further improve the stability of the supporting arm.

One end of the fixing block is detachably connected to a side wall of the vacant portion away from the second tab, and the other end is against a vertical column of the frame body;

One end of the fixing block is detachably connected to a side wall of the vacant portion away from the second tab is provided as follow: the fixing block is provided with a convex portion at one end, and the side wall away from the second tab is provided with a slot corresponds to the convex portion, and the fixing block are detachably connected to the side wall away from the second tab through an engagement of the convex portion and the slot.

The fixing device comprises a connecting member for connecting with the horizontal bar of the frame body; a flat plate for fixing to the wall body; a first fixing member and a second fixing member; the connecting member is at one end of the horizontal bar and is connected to the horizontal bar through the first fixing member; the flat plate is connected to the connecting member and is connected to the wall body through the second fixing member.

A storage rack with side frames, comprising at least two side frames and a plurality of boards; each of the side frames comprises a frame body formed by connecting vertical columns and a horizontal bar; and a plurality of supporting arms provided on the frame body; the vertical columns are provided with a plurality of mounting holes, two ends of each of the supporting arms are respectively connected with mounting holes of two of the vertical columns of the frame body; one end of the horizontal bar of the frame body is provided with a fixing device for installing the frame body to a wall body;

Each of the boards is arranged between the two side frames, and is detachably connected with the supporting arms on the two side frames, respectively.

In the above solution, the supporting arm of the storage rack of the present invention is connected to the vertical columns in a double engagement method, so that the storage rack has better supporting capacity and load bearing effect, thereby improving the practicality and stability of the storage rack. In addition, the storage rack of the present invention can be fixed to the wall through fixing devices. Compared with existing storage racks are only placed on the ground for storage and presentation of the goods, the safety is greatly improved, and the design can also solve the problem that the rack is easy to lean forward due to external forces when the amount of goods is large, thereby solving safety concern and improving the safety performance of use.

Each of the supporting arms is provided with a protruding part; and each of the boards is provided with a through hole; each of the boards is connected to a protruding part via its through hole so that the boards and the supporting arms are detachably connected.

The invention further comprising side panels, storage frames, drawers, storage plates, and storage cabinets; the side panels are connected to the vertical columns of the side frames and are located between two vertical columns; the storage frames are connected to side panels of the two side frames and is arranged between the two side frames; the drawers, the storage plates and the storage cabinets are respectively connected to the vertical columns of the two side frames and are arranged between the two side frames. The storage rack of the present invention can use boards to design the storage space, and can also store or place the goods in various forms of storage frames, drawers, storage plates, and storage cabinets.

The supporting arms of the storage rack of the present invention is connected to the vertical columns of the frame body in this manner: after the body of a supporting arm of the present invention is engaged with the vertical column of the frame body through the vacant position, the first tab and the second tab are engaged and connected to a vertical column of the frame body. Finally, after the body is securely engaged with the vertical column of the frame body, the fixing block is inserted through the convex portion and the slot of a side wall of the vacant portion such that the fixing block is fixed between the side wall of the vacant portion away from the side wall of the second tab and the vertical column of the frame body, to limit the movement of the body of the supporting arm on the vertical column of the frame body, thereby further improving the stability of the supporting arm.

The connection mode of the supporting arms and the vertical columns of the present invention is very special and ingenious:

In the first step, the body of the supporting arm is initially locked with a vertical column of the frame body through the vacant portion to achieve the initial positioning of the body of the supporting arm on the vertical column of the frame body.

In the second step, the first tab and the second tab of the supporting arm are connected with the mounting holes of two vertical columns of the frame body. The mounting holes of the present invention are arranged on the same direction of two vertical columns, so that the engagement directions of the first tab and the second tab are the same, thereby simplifying the structure of the supporting arms and the vertical columns. There is no need to consider whether the installation directions of the two tabs are the same and there is no need to consider the installation positions of the two rows of mounting holes.

In the third step, the fixing block is inserted through the convex portion and the slot of the side wall of the vacant position such that the fixing block is fixed between the side wall of the vacant portion away from the second tab and the vertical column.

Compared with the prior art, the present invention has the following advantages and beneficial effects:

1. The side frame of the present invention has a simple structure and strong practicability. The supporting arms of the side frame can form a stable connection with the frame body of the side frame, thereby improving the structural strength of the side frame.

2. The storage rack of the present invention with the side frame has better supporting capacity and load-bearing effect, thereby improving the practicality and stability of the storage rack.

Among them, 1 represents vertical columns, 1.1 represents mounting holes, 2 represents horizontal bar, 3 represents supporting arms, 3.1 represents a body, 3.2 represents a reinforcing rod, 3.3 represents a supporting portion, 3.5 represents a first tab, 3.6 represents a second tab, 3.7 represents a vacant portion, 3.7.1 represents a slot, 3.8 represents a protruding part, 3.9 represents a fixing block, 3.9.1 represents a convex portion, 4 represents a board, 4.1 represents through holes, 5 represents a side panel, 6 represents a storage frame, 7 represents a drawer, 8 represents a storage board, 9 represents a storage cabinet, 10 represents a fixing device, 10.1 represents a connecting members, 10.2 represents a flat plate, 10.3 represents a first fixing member, 10.4 represents a second fixing member.

DESCRIPTION

The present invention will be described in further detail below with reference to the drawings and specific embodiments.

Example 1

Figure 1:
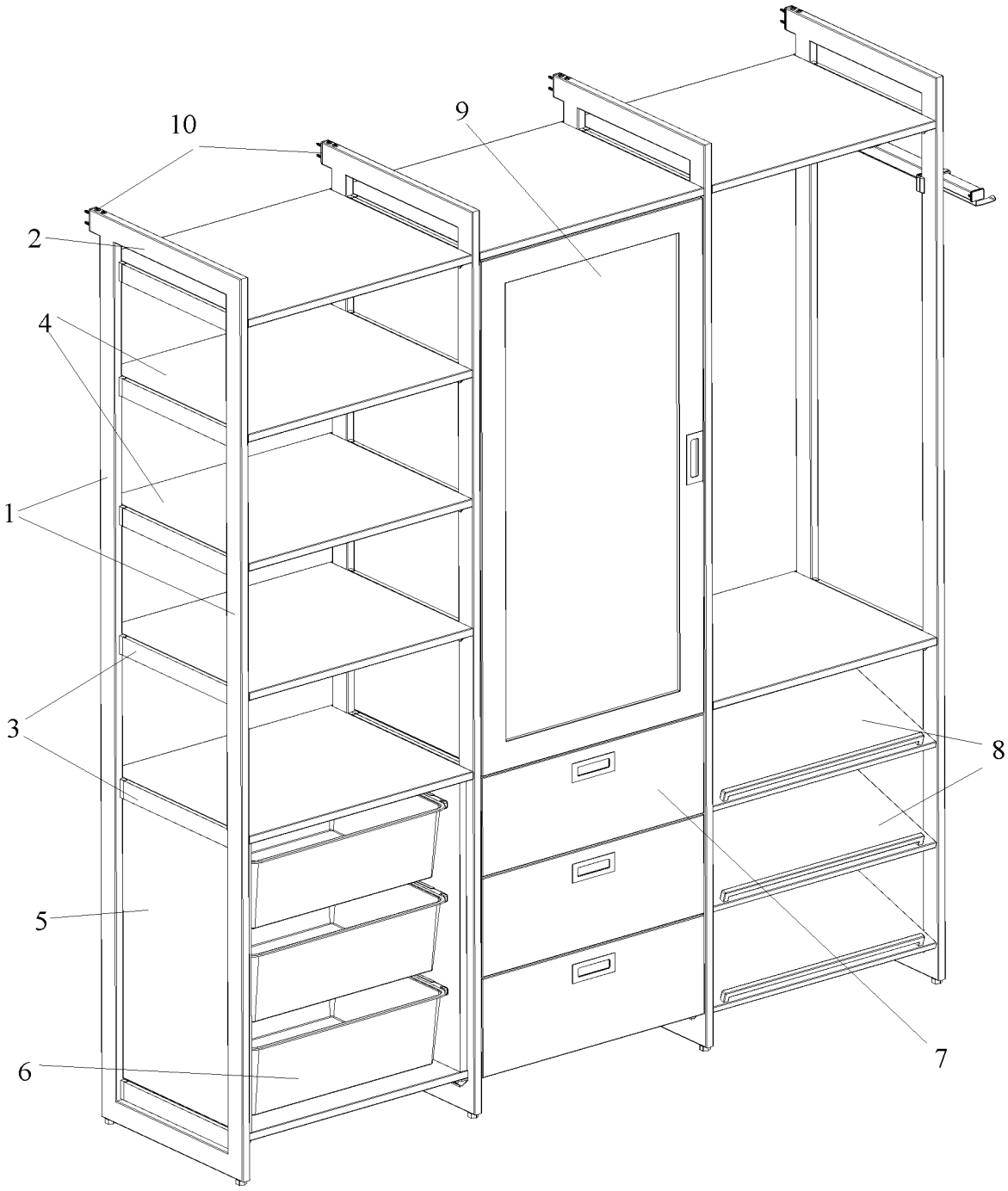
FIG. 1 is a diagram of a storage rack in Example 1.
Figure 2:
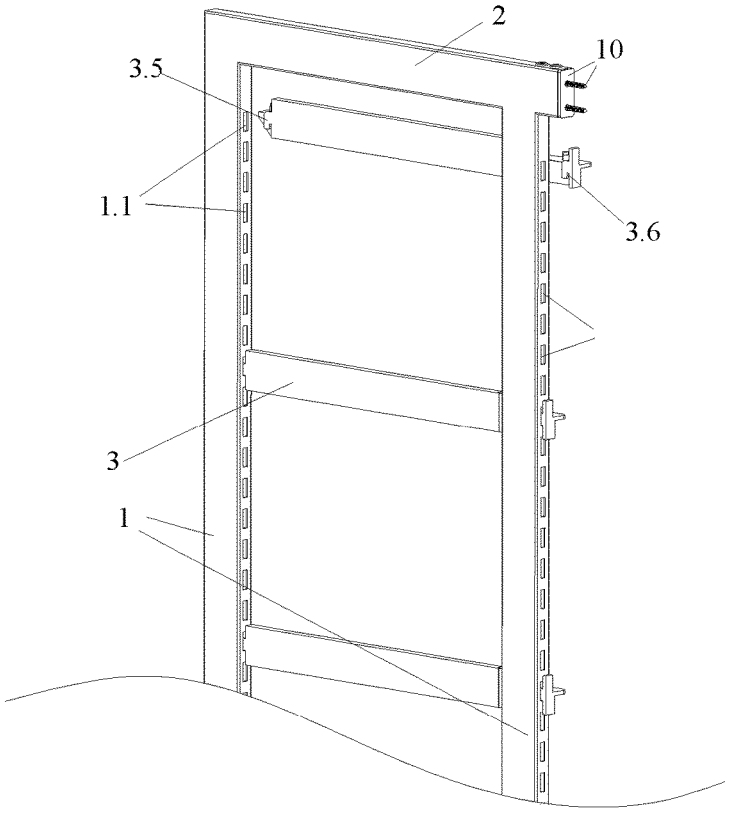
FIG. 2 is a diagram of the side rack in the storage rack of the present invention.
Figure 3:
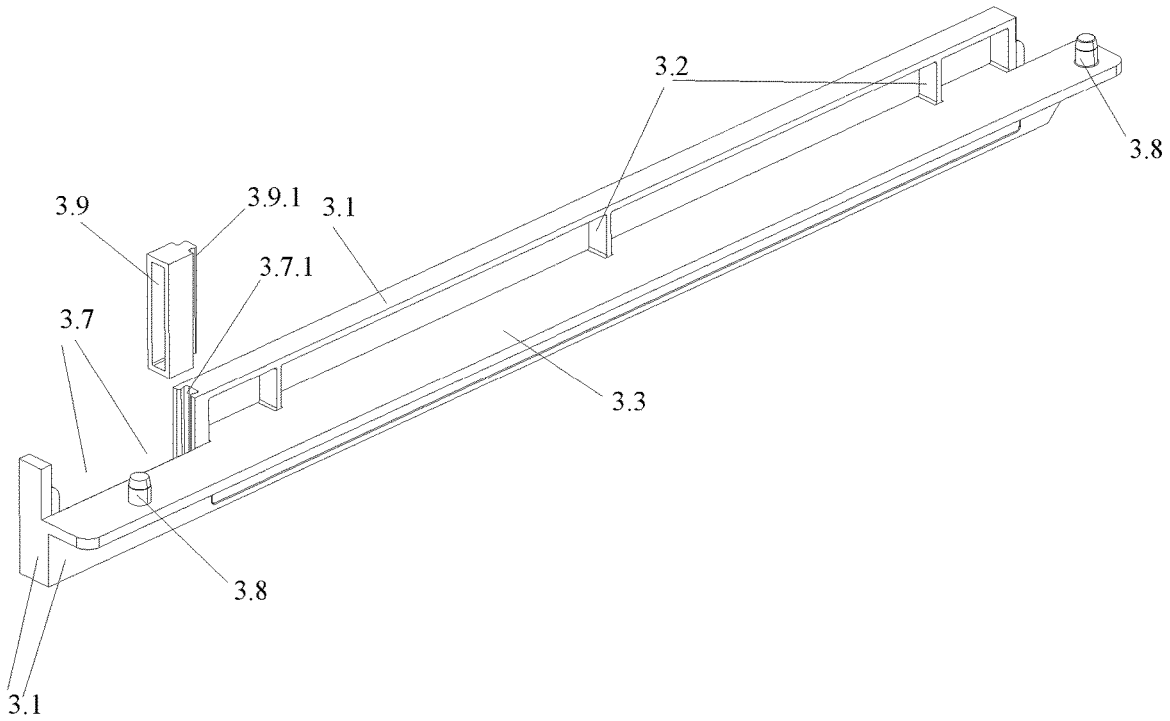
FIG. 3 is diagram 1 of a supporting arm in the side frame of the present invention.
Figure 4:
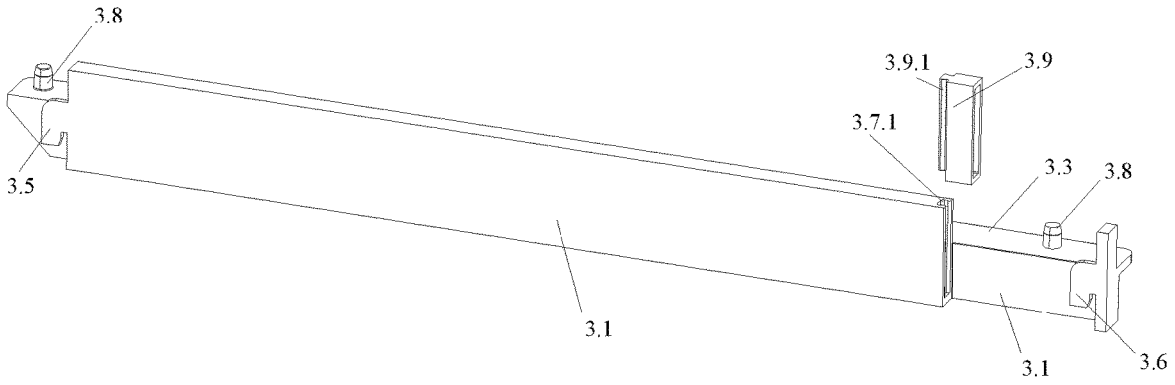
FIG. 4 is diagram 2 of the supporting arm in the side frame of the present invention.
Figure 5:
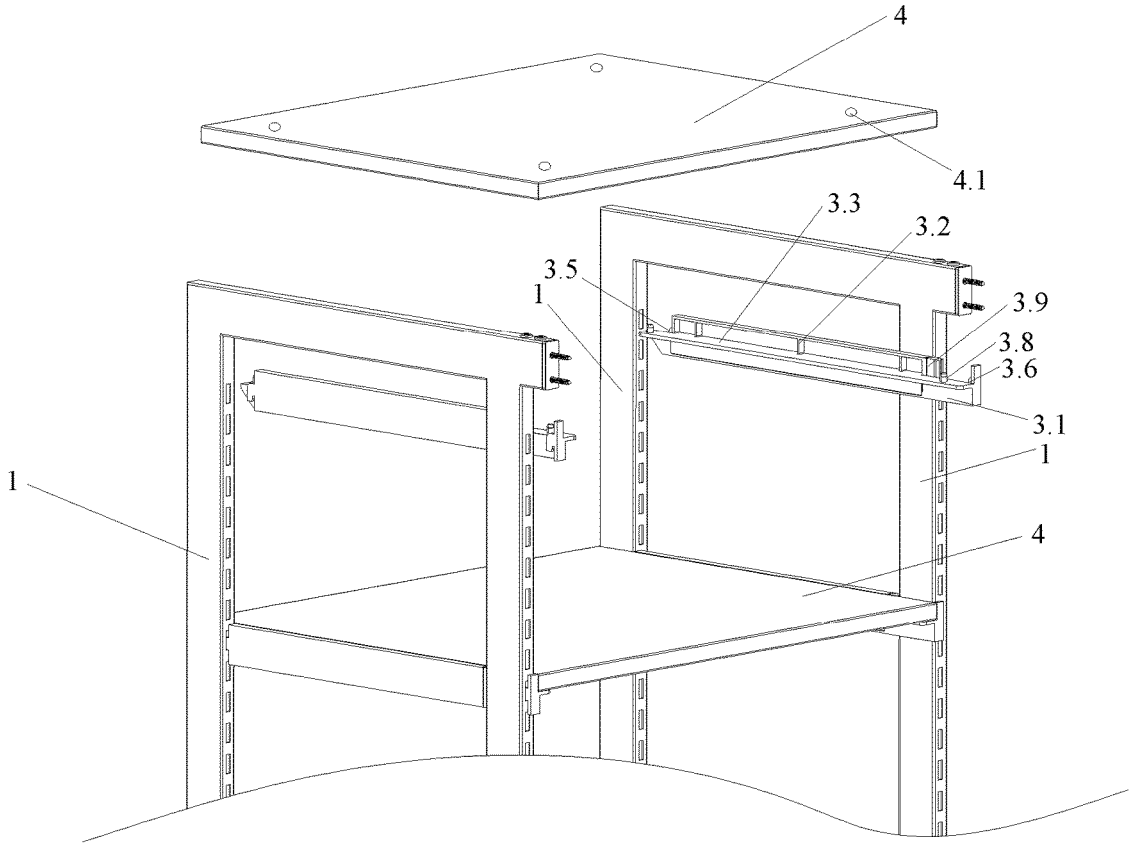
FIG. 5 is a diagram of the connection between supporting arms, a board and vertical columns of the present invention.
Figure 6:
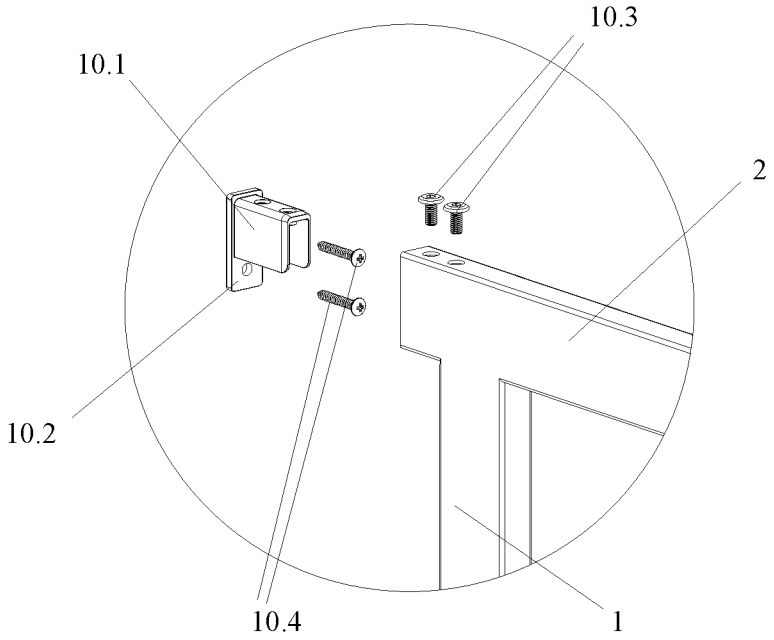
FIG. 6 is a diagram of the connection between the fixing device of the present invention and the side frame.

As shown in FIGS. 1 to 6, the storage rack of the present invention comprises four side frames, several boards 4, side panels 5, storage frames 6, drawers 7, storage boards 8 and storage cabinets 9, wherein each side frame comprises a frame body formed by connecting two vertical columns 1 and a horizontal bar 2 and several supporting arms 3 provided on the frame body. Vertical columns 1 are provided with several mounting holes 1.1, and the two ends of each supporting arms 3 are respectively connected with the frame body and mounting holes 1.1 of two vertical columns 1. One end of horizontal bar 2 of the frame body is provided with a fixing device 10 for mounting the frame body on the wall. The side panel 5 is connected to the vertical columns 1 of the side frame, and is located between the two vertical columns 1, and the storage frame 6 is connected to the side panel 5 of the two side frames and set between the two side frames, and drawer 7, storage board 8, and storage cabinet 9 are respectively connected to the vertical columns 1 of the two side frames and are set between the two side frames.

The supporting arms 3 of the present invention comprise body 3.1, supporting portion 3.3 for mounting board 4, and first tab 3.5 and second tab 3.6 for matching engagement with mounting holes 1.1 of vertical columns 1 of frame body, where body 3.1 is provided with a vacant portion 3.7 to facilitate the engagement of the second tab 3.6 and the vertical columns 1 of the frame body. The supporting portion 3.3 is connected to the body 3.1, the first tab 3.5 is set at one end of the body 3.1, and the second tab 3.6 is close to the other end of the body 3.1 and faces the vacant portion 3.7, and the supporting portion 3.3 for mounting the board 4 is fixed on the frame body through the first tab 3.5 and the second tab 3.6. Both first tab 3.5 and second tab 3.6 are inverted hooks.

The body 3.1 is provided with a vacant portion 3.7 which facilitates the engagement of the second tab 3.6 and the vertical columns 1 of frame body means that the body 3.1 has a concave portion at the end away from the first tab 3.5, and the concave portion serves as vacant portion 3.7 where the body 3.1 and vertical columns 1 of the frame body are engaged. The second tab 3.6 is provided on the side wall of the vacant portion 3.7 and faces the vacant portion 3.7. Moreover, the distance from the second tab 3.6 to the other side wall of the vacant portion 3.7 is greater than a width of an engagement location of a vertical column of the frame body. The design allows body 3.1 to be snapped onto the vertical columns 1 of frame body through the vacant portion 3.7, and there is enough space for the second tab 3.6 to engage with the vertical columns 1 of frame body.

The supporting portion 3.3 of the invention is vertically connected with the body 3.1, and is integrally formed with the body 3.1. This design can improve the structural strength of supporting arms 3. In order to strengthen the connection between the supporting portion 3.3 and the body 3.1, the present invention further comprises a reinforcing rod 3.2, and the body 3.1 is connected to the supporting portion 3.3 through the reinforcing rod. The supporting portion 3.3 is provided with at least one protruding part 3.8 for installing boards 4. Each of boards 4 of the present invention is positioned between two side frames, and is detachably connected to the supporting arms 3 on the two side frames, specifically: through holes 4.1 is provided on the boards 4 for connecting with the protruding part 3.8 and boards 4 can achieve a stable installation on the supporting portion 3.3 through a connection of the through holes 4.1 and the protruding part 3.8, and this method can achieve the detachable connection of boards 4 and supporting arms 3.

The invention also comprises a fixing block 3.9 for restricting the movement of the body 3.1 on the vertical columns 1 of frame body, the fixing block 3.9 is detachably connected to the side wall of the vacant portion 3.7, and when used is located between the side wall of the vacant portion 3.7 and vertical columns 1 of frame body. When supporting arms 3 are connected to vertical columns 1 of frame body with first tab 3.5 and second tab 3.6, by inserting fixing block 3.9 between the side wall of vacant portion 3.7 and vertical columns 1 of frame body, the body 3.1 of supporting arms can be restricted from moving on vertical columns 1 of frame body to further improve the stability of supporting arms 3. One end of the fixing block 3.9 of the present invention is detachably connected to the side wall of the vacant portion 3.7 away from the second tab 3.6, and the other end is against vertical columns 1 of frame body. Specifically, the fixing block 3.9 and the side wall of the vacuum portion 3.7 are connected as follows: one end of the fixing block 3.9 is provided with a convex portion 3.9.1, and the side wall of the vacuum portion 3.7 away from the second tab 3.6 is provided with the matching slot 3.7.1 correspond to the convex portion 3.9.1. Fixing block 3.9 can be detachably connected to the side wall of the vacant portion 3.7 away from the second tab 3.6 through the insertion of the convex portion 3.9.1 to slot 3.7.1.

The fixing device 10 of the present invention comprises connecting members 10.1 for connecting with the frame body horizontal bar 2, flat plate 10.2 and first fixing member 10.3 and second fixing member 10.4 for clinging to the wall, wherein connecting members 10.1 is positioned at the end of horizontal bar 2, and is connected to horizontal bar 2 through first fixing member 10.1. Flat plate 10.2 is connected to connecting members 10.1, and is connected to wall through second fixing member 10.4.

The supporting arms 3 of the storage rack of the present invention is connected to the vertical columns 1 of the frame body in this manner: after the body 3.1 of a supporting arm of the present invention is engaged with a vertical column 1 of the frame body through the vacant position 3.7, the first tab 3.5 and the second tab 3.6 are engaged and connected to a vertical column 1 of the frame body. Finally, after the body 3.1 is securely engaged with the vertical column 1 of the frame body, the fixing block 3.9 is inserted through the convex portion 3.9.1. and the slot 3.7.1 of a side wall of the vacant portion 3.7 such that the fixing block 3.9 is fixed between the side wall of the vacant portion 3.7 away from the side wall of the second tab 3.6 and the vertical column 1 of the frame body, to limit the movement of the body 3.1 of supporting arm on the vertical column 1 of the frame body, thereby further improving the stability of the supporting arms 3.

The connection mode of the supporting arms 3 and the vertical columns 1 of the present invention is very special and ingenious:

In the first step, the body 3.1 of the supporting arm body is initially locked with a vertical column 1 of the frame body through the vacant portion 3.7 to achieve the initial positioning of the body 3.1 of the supporting arm on the vertical column 1 of the frame body.

In the second step, the first tab 3.5 and the second tab 3.6 of the supporting arm 3 are connected with the mounting holes 1.1 of two vertical columns 1 of the frame body. The mounting holes 1.1 of the present invention are arranged on the same direction of two vertical columns 1, so that the engagement directions of the first tab 3.5 and the second tab 3.6 are the same, thereby simplifying the structure of the supporting arms 3 and the vertical columns 1. There is no need to consider whether the installation directions of the two tabs are the same and there is no need to consider the installation positions of the two rows of mounting holes 1.1.

In the third step, the fixing block 3.9 is inserted through the convex portion 3.9.1 and the slot 3.7.1 of the side wall of the vacant position 3.7 such that the fixing block 3.9 is fixed between the side wall of the vacant portion 3.7 away from the second tab 3.6 and the vertical column 1.

Example 2

This example differs from the first example only in that: the storage rack of this embodiment may comprise two side frames, three side frames or more than five side frames, and several boards according to actual needs, while the side panel, storage frame, drawer, storage board and storage cabinet can be freely combined and set according to requirements.

The connection structure and method of the boards and the side frames in this embodiment are the same as those in the first embodiment.

The above examples are preferred embodiments of the present invention, but the embodiments of the present invention are not limited by the above examples. Any other changes, modifications, substitutions, combinations, simplifications, etc. made without departing from the spirit and principle of the present invention should all be equivalent replacement methods, which are all included within the protection scope of the present invention.

The invention claimed is:

1. A side frame, comprising: a frame body formed by connecting vertical columns and a horizontal bar; and a plurality of supporting arms provided on the frame body; the vertical columns are provided with a plurality of mounting holes, two ends of each of the supporting arms are respectively connected with mounting holes of two of the vertical columns of the frame body; one end of the horizontal bar of the frame body is provided with a fixing device for installing the frame body to a wall body; wherein the fixing device comprises a connecting member for connecting with the horizontal bar of the frame body, a flat plate for fixing to the wall body, a first fixing member and a second fixing member; the connecting member is at one end of the horizontal bar and is connected to the horizontal bar through the first fixing member; the flat plate is connected to the connecting member and is connected to the wall body through the second fixing member.

2. The side frame according to claim 1, wherein each of the supporting arms comprises a body; a supporting portion for installing a board; and a first tab and a second tab for engaging the mounting holes of the vertical columns of the frame body; the body is provided with a vacant portion for the second tab to be engaged with a vertical column of the frame body; the supporting portion is connected to the body; the first tab is provided at one end of the body, the second tab is disposed near the other end of the body and facing the vacant portion, so that the supporting portion for installing the board is fixed on the frame body through the first tab and the second tab.

3. The side frame according to claim 2, wherein the vacant portion of the body for the second tab to be engaged with a vertical column of the frame body is provided as follow: an end of the body away from the first tab is provided with a concave portion, and the concave portion is used as the vacant portion where the body and a vertical column of the frame body are engaged; the second tab disposed near the other end of the body and facing the vacant portion is provided as follow: the second tab is provided on a side wall of the vacant portion and facing the vacant portion; a distance from the second tab to another side wall of the vacant portion is greater than a width of an engagement location of the vertical column of the frame body.

4. The side frame according to claim 2, wherein the supporting portion is integrally formed with the body; the supporting portion is provided with at least one protruding part for installing a board.

5. The side frame according to any one of claim 2, further comprising a fixing block for restricting a movement of the body of a supporting arms on the frame body; the fixing block is detachably connected to a side wall of the vacant portion, and when used, it is located between the side wall of the vacant portion and a vertical column of the frame body.

6. The side frame according to claim 5, wherein one end of the fixing block is detachably connected to a side wall of the vacant portion away from the second tab, and another end is against a vertical column of the frame body; wherein one end of the fixing block is detachably connected to a side wall of the vacant portion away from the second tab is provided as follow: the fixing block is provided with a convex portion at one end, and the side wall away from the second tab is provided with a slot corresponds to the convex portion, and the fixing block are detachably connected to the side wall away from the second tab through an engagement of the convex portion and the slot.

7. A storage rack, comprising two side frames and a plurality of boards; each of the two side frames comprises a frame body formed by connecting two vertical columns and a horizontal bar; and a plurality of supporting arms provided on the frame body; the two vertical columns are provided with a plurality of mounting holes, two ends of each of the supporting arms are respectively connected with mounting holes of the two vertical columns of the frame body; one end of the horizontal bar of the frame body is provided with a fixing device for installing the frame body to a wall body; each of the boards is arranged between the two side frames, and is detachably connected with the supporting arms on the two side frames, respectively; wherein the fixing device comprises a connecting member for connecting with the horizontal bar of the frame body, a flat plate for fixing to the wall body, a first fixing member and a second fixing member; the connecting member is at one end of the horizontal bar and is connected to the horizontal bar through the first fixing member; the flat plate is connected to the connecting member and is connected to the wall body through the second fixing member.

8. The storage rack according to claim 7, wherein each of the supporting arms is provided with a protruding part; and each of the boards is provided with a through hole; each of the boards is connected to a protruding part via its through hole so that the boards and the supporting arms are detachably connected.

9. The storage rack according to claim 7, further comprising two side panels and a storage frames, each of the two side panels is connected to the two vertical columns and is located between the two vertical columns; the storage frames is connected to the two side panels and is arranged between the two side frames.

10. The storage rack according to claim 7, further comprising a drawer, the drawer is connected to the vertical columns of the two side frames and is arranged between the two side frames.

11. The storage rack according to claim 7, further comprising a storage plate, the storage plate is connected to the vertical columns of the two side frames and is arranged between the two side frames.

12. The storage rack according to claim 7, further comprising a storage cabinet, the storage cabinet is connected to the vertical columns of the two side frames and is arranged between the two side frames.

* * * * *